US007882666B2

(12) United States Patent
Karalic

(10) Patent No.: US 7,882,666 B2
(45) Date of Patent: Feb. 8, 2011

(54) BUILDING COMPONENTS AND METHOD OF MAKING SAME

(76) Inventor: Meho Karalic, F-1133 East 29th Street, North Vancouver, British Columbia (CA) V7K 1C3

( * ) Notice: Subject to any disclaimer, the term of this patent is extended or adjusted under 35 U.S.C. 154(b) by 63 days.

(21) Appl. No.: 09/414,483

(22) Filed: Oct. 8, 1999

(65) Prior Publication Data

US 2001/0039777 A1 Nov. 15, 2001

(51) Int. Cl.
*E04B 1/38* (2006.01)
*E04C 2/38* (2006.01)

(52) U.S. Cl. ..... 52/280; 52/242; 52/281; 52/241; 52/461; 52/586.1; 52/586.2; 52/656.1; 52/656.9; 52/655.1; 52/665; 52/453; 52/454; 403/170; 403/174; 403/178; 403/217

(58) Field of Classification Search ..... 52/454, 52/443, 601, 741.41, 655.1, 665, 481.1, 404.1, 52/656.9, 282, 280, 281, 242–241, 238.1, 52/461, 464, 586.1, 586.2, 202, 22, 476, 52/628; 403/169–178, 295, 217
See application file for complete search history.

(56) References Cited

U.S. PATENT DOCUMENTS 813,253 A * 2/1906 Sullivan
1,837,630 A * 12/1931 Pawling
1,888,841 A * 11/1932 Wenzel et al.
2,611,160 A * 9/1952 Hanesse ..... 403/237
3,034,609 A * 5/1962 Young ..... 189/34
3,087,768 A * 4/1963 Mack et al. ..... 312/265.4
3,188,696 A * 6/1965 Earhart ..... 52/241
3,258,889 A * 7/1966 Butcher ..... 52/309.11
3,272,582 A * 9/1966 Mack et al. ..... 312/265.4
3,480,313 A * 11/1969 Halko, Jr ..... 403/295
3,537,221 A * 11/1970 Helfman et al. ..... 52/289
3,609,936 A * 10/1971 Toscano ..... 52/745.02
3,615,110 A * 10/1971 Fugate ..... 403/230
3,641,724 A * 2/1972 Palmer ..... 52/793.11
3,831,338 A * 8/1974 Klingensmith et al. ..... 403/400
3,875,721 A * 4/1975 Mengeringhausen et al. ..... 52/731.3
4,196,556 A * 4/1980 Russo ..... 52/714
4,292,775 A * 10/1981 Howard ..... 52/220
4,422,792 A * 12/1983 Gilb ..... 403/232.1
4,577,449 A * 3/1986 Celli ..... 52/737.2
4,647,496 A * 3/1987 Lehnert et al. ..... 442/386
4,671,032 A * 6/1987 Reynolds ..... 52/210
4,676,038 A * 6/1987 Doyon et al. ..... 52/282.2
4,856,244 A * 8/1989 Clapp ..... 52/309.7
4,914,883 A * 4/1990 Wencley ..... 52/309.5
5,148,645 A * 9/1992 Lehnert et al. ..... 52/443
5,186,571 A * 2/1993 Hentzschel ..... 403/231

(Continued)

FOREIGN PATENT DOCUMENTS

CA 2196869 7/1995

*Primary Examiner*—Jeanette E. Chapman
(74) *Attorney, Agent, or Firm*—Cameron IP

(57) ABSTRACT

A prefabricated building component, e.g. for incorporation in a wall, a floor, a roof or another building component, comprises a frame formed by lengths of lumber with heat insulating foam material provided in spaces between the lumber so as to form a heating insulating barrier. To reinforce the frame against racking forces, a reinforcement sheet of fiber reinforced composite material is provided on the barrier and the lumber at least one side of the frame.

6 Claims, 3 Drawing Sheets

U.S. PATENT DOCUMENTS 5,371,989 A * 12/1994 Lehnert et al. ..... 52/309.17
5,625,995 A * 5/1997 Martin ..... 52/715
5,647,687 A * 7/1997 Robinson et al. ..... 403/403
5,765,330 A * 6/1998 Richard ..... 52/309.13
5,820,289 A * 10/1998 Kern et al. ..... 403/231
6,047,518 A * 4/2000 Lytle ..... 52/742.13
6,061,986 A * 5/2000 Canada ..... 52/561
6,088,982 A * 7/2000 Hiesberger ..... 52/241
6,105,321 A * 8/2000 KarisAllen et al. ..... 52/223.8
6,110,996 A * 8/2000 Ginsberg ..... 523/466
6,262,164 B1 * 7/2001 Church et al. ..... 524/494
6,430,890 B1 * 8/2002 Chiwhane et al. ..... 52/715

* cited by examiner

BUILDING COMPONENTS AND METHOD OF MAKING SAME

BACKGROUND OF THE INVENTION

1. Field of the Invention

The present invention relates to building components, for incorporation into building structures, and to methods of making building components.

2. Description of the Related Art

In the construction of timber frame buildings, it has previously been proposed to prefabricate a rectangular frame, formed of lengths of lumber connected together to form the frame, and to subsequently incorporate this prefabricated frame in the wall of a timber frame building structure so as to reinforce the wall against racking forces produced, for example, by hurricanes or earthquakes.

Such prefabricated rectangular frames can be reinforced against racking forces by lengths of lumber suitably arranged within the frame and interconnecting the sides, top and bottom of the frame, by suitable sheathing and/or by metal corner reinforcements provided at the corners of the frame.

BRIEF SUMMARY OF THE INVENTION

The present invention is based on the concept that a prefabricated building component in the form of a frame can advantageously be reinforced by applying a reinforcement sheet to a part or to the entirety of at least one side of the frame so as to form a hardened reinforcement layer or "skin" on the frame, this layer or "skin" being resistant to outside forces and, thus, to deformation of the frame by racking forces.

The reinforcement sheet may be a coating material applied in a flowable condition to the frame and may be reinforced by fibers to form a fiber reinforced composite. For example, a mesh of reinforcement fibers can be applied to one or both sides of the frame and the layer of the coating material can then be applied, in a flowable condition, onto the mesh so as to penetrate the mesh and to adhere to the lumber of the frame.

Alternatively, the reinforcement sheet may be made separately from the frame and subsequently applied as a prefabricated reinforcement sub-component to the frame.

Preferably, heat insulating foam material is provided in the frame between the lengths of lumber so as to form a heat barrier, and the coating material is applied so as to coat and adhere to one side of this heat insulating barrier.

BRIEF DESCRIPTION OF THE DRAWINGS

The invention will be more readily understood from the following description of a preferred embodiment thereof given, by way of example, with reference to the accompanying drawings, in which:—

DESCRIPTION OF THE PREFERRED EMBODIMENT

Figure 1:
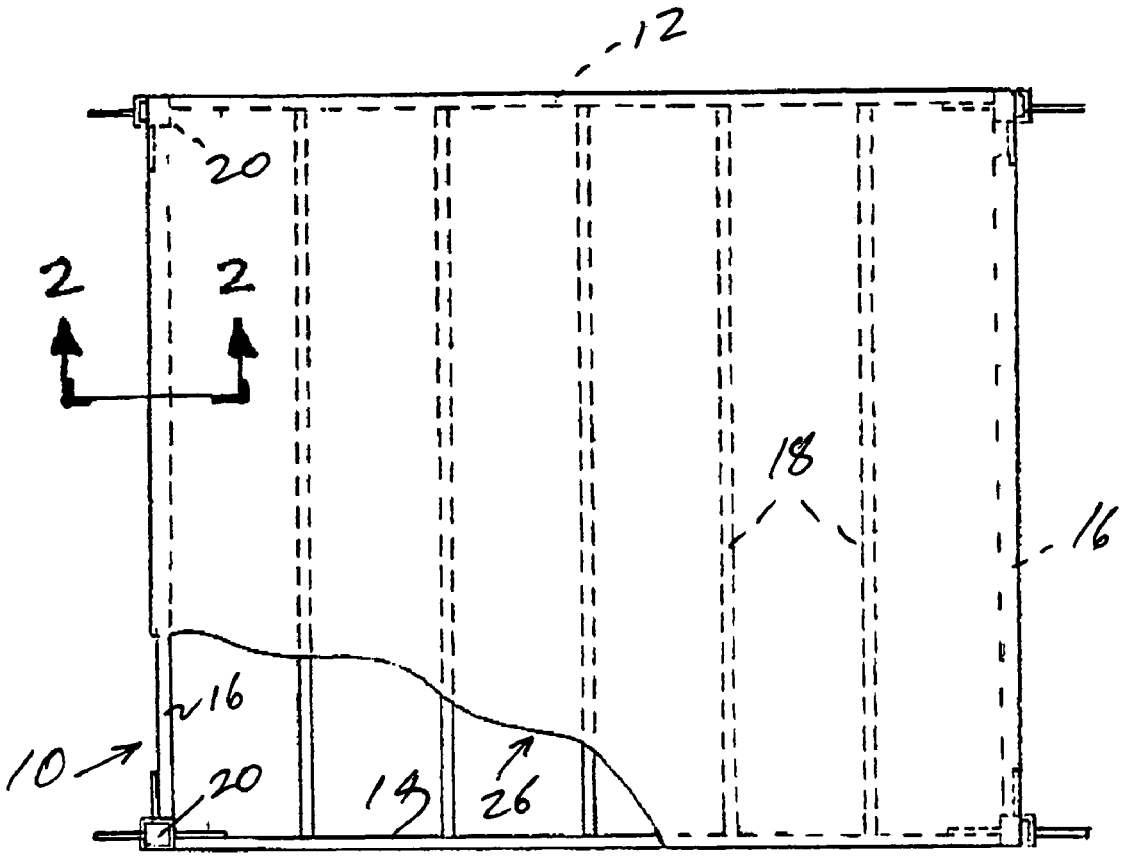
FIG. 1 shows a view in front elevation of a building component according to one embodiment of the present invention.

As shown in FIG. 1 of the drawings, a building component, which is indicated generally by reference numeral 10, comprises a rectangular frame assembled from vertical and horizontal lengths of lumber and, more particularly, the frame is formed by horizontal top and bottom rails 12 and 14, by opposite vertical side members 16 and by vertical studs 18 spaced apart from one another, in a conventional manner, between the side members 16 and extending between the top and bottom rails 12 and 14. These lengths of lumber are connected to one another, in a conventional manner, by nails (not shown), and in addition metal corner connectors or reinforcements 20 are provided at the four corners of the frame, interposed between and interconnecting the top and bottom rails 12 and 14 and the side members 16.

In the spaces between the top and bottom rails 12 and 14, the side members 16 and the studs 18, a heat insulating foam material 22 is provided so as to form a heat insulating barrier 24. As can be seen in the cross-section of view of FIG. 2, this heat insulating barrier 24 occupies only approximately one half of the spaces between the studs 18 and the side members 16, so as to leave the remainders of these spaces free for accommodating plumbing, electrical conduits, etc.

Over one entire side of the frame, there is a provided a reinforcement sheet in the form of a coating layer indicated generally by reference numeral 26. This reinforcement coating layer 26 adheres to the lengths of lumber and to the heat insulating barrier 24 at this one side of the building component 10 and, in addition, overlaps and adheres to a portion of the periphery of the frame.

Within the reinforcement layer 26 there is provided a reinforcement of fiber material and, more particularly, a mesh 28 of fiber material, which likewise extends over the entire area of one side of the frame and, also, overlaps the peripheral of the frame.

One material which has been found to be suitable as the material of the reinforcement coating layer is sold under the trade mark GINSITE by Ginsite Materials, Inc., of Plantation, Fla., U.S.A., but other suitable coating materials may be substituted. It is, however, a requirement of the coating material that it can be applied and adhered to the frame and that it subsequently resists forces exerted on the coating material and, thus, will resist distortion of the frame by racking forces applied to the frame.

In the present embodiment of the invention, the fiber material of the mesh 28 is glass fiber. However, other suitable fiber materials may be alternatively employed. For example, carbon fiber, aramid fiber, organic fiber material such as sisal, bamboo, wood or straw, or metal fibers, such as steel, aluminum, etc., may be utilized.

For further information as to suitable fiber reinforced composite materials, reference is made to THE SCIENCE AND TECHNOLOGY OF ENGINEERING MATERIALS", pp. 359-363, by J. Francis Young, published by Prentice-Hall, Inc.

It may be possible, in some cases, to omit the reinforcement fibers, provided that the coating material itself provides sufficient resistance to racking forces.

Figure 1A:
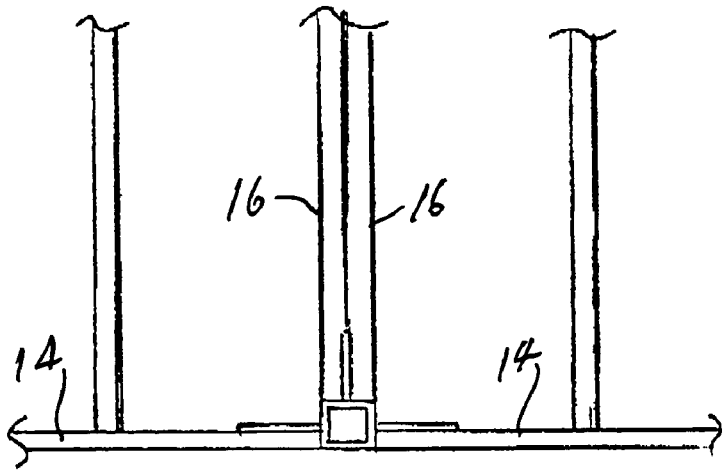
FIG. 1A shows a broken-away view of an adjacent pair of building components such as that of FIG. 1.
Figure 1B:
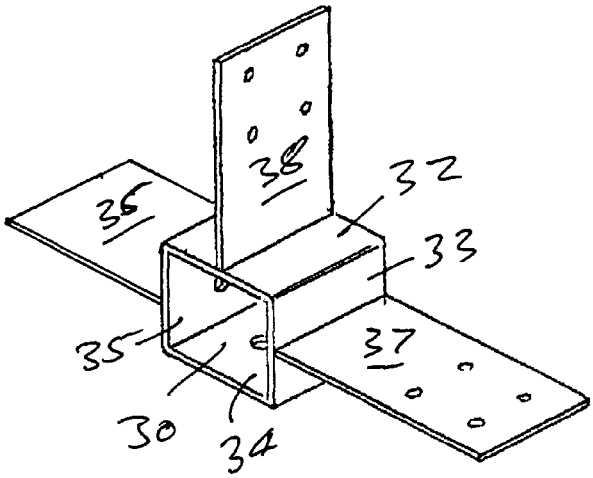
FIG. 1B shows a view in perspective of a corner connector employed in the building components of FIGS. 1 and 1A.

One of the corner reinforcements 20 is shown in greater detail in FIG. 1B and comprises a box-shaped section 30 having a horizontal top wall 32, vertical side walls 33 and 35 and a horizontal bottom wall 34; laterally extending flange 36 and 37 projecting horizontally from the vertical side walls 33 and 35 and a vertically extending flange 38 projecting upwardly from the horizontal top wall 32 of the box-shaped section 30. More particularly, the flanges 36 and 38 extend from the mid-sections of the sides 33 and 32, which as can be seen from FIG. 1A are dimensioned so that the flanges 36 and 37 fit snugly on top of the rails 14 of an adjacent pair of the frames of FIG. 1, while the vertical flange 38 fits between and in face-to-face contact, laterally thereof, with the vertical side members 16 of these two frames. The flanges 36, 37 and 38 are secured to the frames by nails or staples (not shown), a pair of vertical, lengths of lumber, i.e. the side members 16, in abutment longitudinally thereof, with the horizontal top wall 32, and in face-to-face contact, laterally thereof, with the vertical flange 38, and with the horizontal lengths of lumber, i.e. the rails 14, in abutment longitudinally thereof with respective ones of the side walls 33 and 35, as illustrated in FIG. 1A.

Figure 1C:
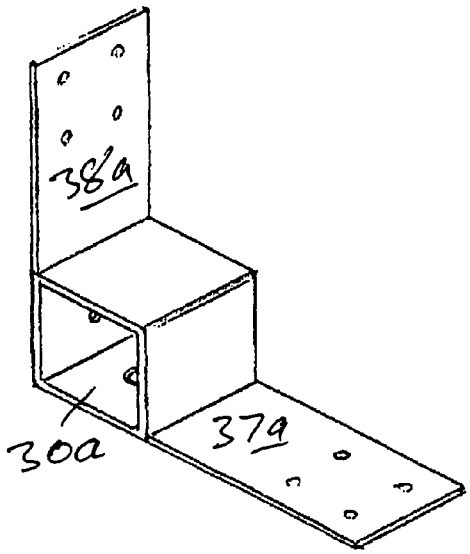
FIG. 1C shows a view in perspective of a modification of the corner connector of FIG. 1B.
Figure 4:
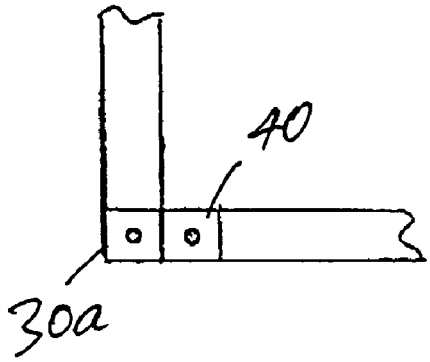
FIG. 4 shows a view in side elevation of a further corner connector.

The modified corner connector shown in FIG. 1C and indicated generally by reference numeral 20*a* has a box-shaped section 30*a* with horizontal and vertical flanges 37*a* and 38*a*, but in this case the flanges 37*a* and 38*a* are located in alignment with the bottom wall and one side wall of the box-shaped section 30*a*. This corner connector 20*a* is intended for connection to the lumber of only one of the frames, so as to not project from the frame. If required, the corner connector 20*a* of FIG. 1C can be further modified by the addition of a vertical flange 40 (FIG. 4) extending along one or both longitudinal sides of the lateral flange 37*a* and secured to the rail 14 by nails or staples (not shown).

In the making of the building component 10, the lengths of lumber are firstly connected to one another by nailing and by attaching them to the metal corner connectors in the manner described above in order to form the frame, and the heat insulating foam material 22 is then injected into the frame so as to form the heat insulating barrier 24.

The reinforcement fiber material mesh is then spread over one side of the frame, on the lumber and the heat insulating barrier 24, and the coating material is subsequently applied onto the reinforcement fiber material mesh so that it impregnates the mesh and adheres to the lumber and to the heat insulating barrier 24. The material may be thus applied manually by e.g. a trowelling or scraping action, or by spraying, e.g. by relative movement between the frame and one or more spray nozzles. The coating material is then left to harden so as to form the reinforcement "skin" or sheet on the frame Alternatively, the barrier 24 may be formed between the lengths of lumber after the reinforcement layer 26 has been formed., the fiber material mesh being applied to the frame prior to the application of the heat insulating foam material.

Figure 2:
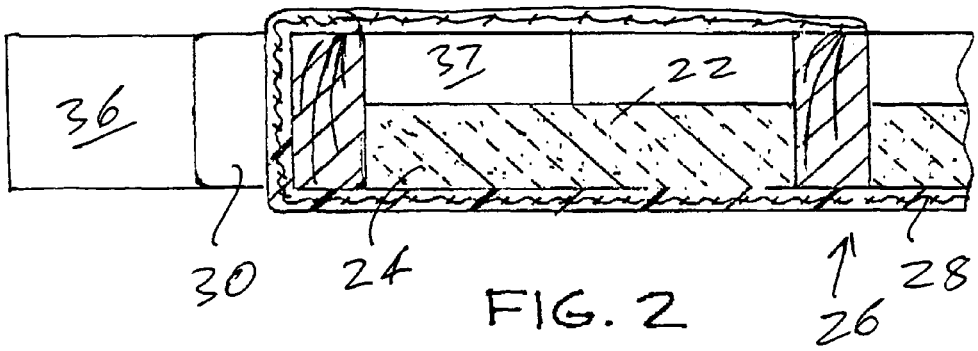
FIG. 2 shows a broken-away view taken in section along the line 2-2 of FIG. 1.

As shown in FIG. 2, the reinforcement layer 26 is applied on both sides, on the peripheral edge and on a portion of the rear side of the G1 frame, although it may be applied so as to cover only a portion of one or both sides of the frame.

Figure 3:
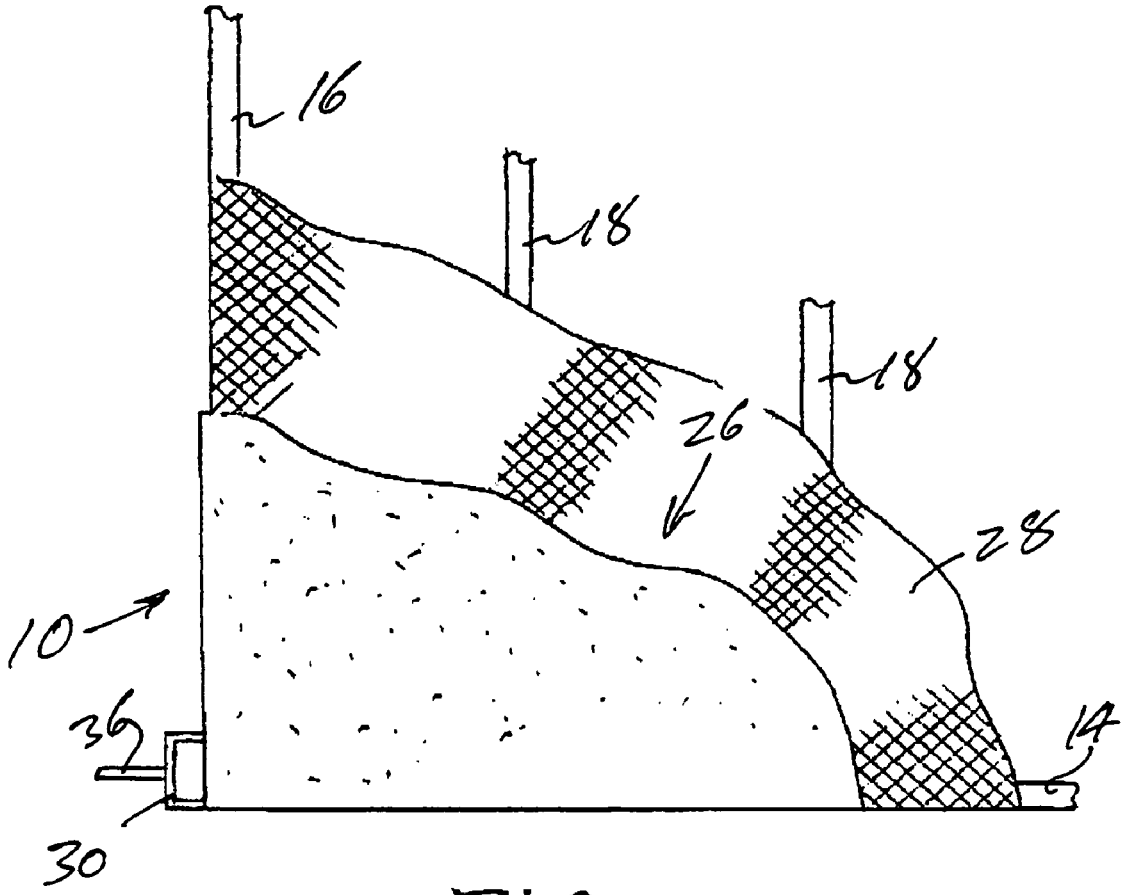
FIG. 3 shows a broken-away view in front elevation of a corner portion of the building component of FIGS. 1 and 2.

Thus, it is to be understood that FIGS. 1 to 3 illustrate only one embodiment of the invention, and that various modifications may be made within the scope of the present invention.

For example, it may not always be essential for the reinforcement sheet or "skin" to be co-extensive with one side of the frame but, rather, this sheet may be provided in the form of a diagonal strip or diagonal X-shape to the frame. It is not essential for the frame to be rectangular.

Also, while the building component 10 is intended for subsequent incorporation into the wall of a timber frame building, it is to be understood that the present invention is not restricted to wall components but may, for example, be employed for panels for roofs, floors or other structural components.

I claim:

1. A building component, comprising:

a plurality of lengths of lumber connected together to form a rectangular frame around an opening;

a foam material provided in said opening;

a reinforcement skin of composite material adhering to said lengths of lumber and to said foam material at one side of said frame;

said reinforcement skin extending over said lengths of lumber at said one side of said frame and also over said opening, whereby said rectangular frame is reinforced by said reinforcement skin against the action of racking forces on said rectangular frame;

metal corner connectors interposed between and interconnecting said lengths of lumber at corners of said rectangular frame;

said corner connectors each comprising a box-shaped intermediate section;

said intermediate section having opposite vertical side walls, a horizontal top wall and a horizontal bottom wall;

said corner connectors each including a horizontal flange projecting from one of said vertical side walls and a vertical flange projecting upwardly from said horizontal top wall; and said lengths of lumber comprising vertical and horizontal lengths of lumber extending at right angles to and in abutment longitudinally thereof with said horizontal top wall and said one of said side walls, respectively, and being in face-to-face contact, laterally thereof, with said vertical and horizontal flanges, respectively.

2. A building component as claimed in claim 1, wherein said reinforcement skin extends over the entirety of said one side of said frame.

3. A building component as claimed in claim 1, wherein said reinforcement skin overlaps and adheres to the periphery of said rectangular frame.

4. A building component as claimed in claim 1, wherein said reinforcement skin overlaps and adheres to an opposite side of said frame.

5. A building component as claimed in claim 1, wherein said composite material is reinforced with fiber.

6. A building component as claimed in claim 1, including a fiber mesh reinforcing said composite material.

* * * * *